US007343661B2

(12) United States Patent
Horng et al.

(10) Patent No.: US 7,343,661 B2
(45) Date of Patent: Mar. 18, 2008

(54) METHOD FOR MAKING CONDENSER MICROPHONES

(75) Inventors: Ray-Hua Horng, Taichung (TW); Zong-Ying Lin, Changhua Hsien (TW); Jean-Yih Tsai, Taichung Hsien (TW); Chao-Chih Chang, Taichung (TW)

(73) Assignee: Taiwan Carol Electronics Co., Ltd. (TW)

( * ) Notice: Subject to any disclaimer, the term of this patent is extended or adjusted under 35 U.S.C. 154(b) by 130 days.

(21) Appl. No.: 11/409,615

(22) Filed: Apr. 24, 2006

(65) Prior Publication Data

US 2007/0245542 A1 Oct. 25, 2007

(51) Int. Cl.
*H04R 31/00* (2006.01)

(52) U.S. Cl. ..... 29/594; 29/25.42; 29/609.1; 381/174; 381/191; 367/178; 367/180; 438/365; 438/378; 438/486

(58) Field of Classification Search ..... 29/25.42, 29/594, 602.1, 69.1, 876, 877; 216/62, 66, 216/67; 156/308.2, 309.6, 309.9, 320; 381/174, 381/191; 367/178, 180; 427/96, 97, 116, 427/123, 124; 438/3, 42, 57, 98
See application file for complete search history.

(56) References Cited

U.S. PATENT DOCUMENTS 6,677,214 B1 * 1/2004 Shindo et al. ..... 438/365
6,708,387 B2 * 3/2004 Tanabe et al. ..... 29/594
6,928,178 B2 * 8/2005 Chang ..... 381/191

* cited by examiner

*Primary Examiner*—Paul D. Kim
(74) *Attorney, Agent, or Firm*—Ostrolenk, Faber, Gerb & Soffen, LLP

(57) ABSTRACT

A method for making condenser microphones includes: forming a fixed electrode layer structure of a plurality of fixed electrode units; forming a sacrificial layer of a plurality of sacrificial units on one side of the fixed electrode layer structure; forming a diaphragm layer structure of a plurality of diaphragm units on the sacrificial layer; forming a patterned mask layer on an opposite side of the fixed electrode layer structure opposite to the sacrificial layer; forming a plurality of etching channels, each of which extends through the patterned mask layer and the fixed electrode layer structure; removing a portion of the sacrificial layer of each of the sacrificial units so as to form a spacer between a respective one of the fixed electrode units and a respective one of the diaphragm units; and removing the patterned mask layer.

13 Claims, 13 Drawing Sheets

METHOD FOR MAKING CONDENSER MICROPHONES

BACKGROUND OF THE INVENTION

1. Field of the Invention

This invention relates to a method for making condenser microphones.

2. Description of the Related Art

Much attention has been paid to semiconductor condenser microphones due to the advantages of small size, reduced weight, precisely controlled dimension and pattern, batch production, low cost, and easy integration with relevant electronic components.

Conventional methods for making a condenser microphone include a single-wafer process and a two-wafer process. In the two-wafer process, the diaphragm and the back plate are formed on separate silicon wafers, which are then bonded together. After bonding, the pair of the wafers is diced into individual capacitor devices for making condenser microphones. In the single-wafer process, after formation of the layered structures, the silicon wafer is also required to be diced into individual capacitor devices.

The aforesaid conventional methods are disadvantageous in that the individual capacitor devices thus formed are likely to be damaged due to the dicing operation, which results in a decrease in the production yield.

SUMMARY OF THE INVENTION

Therefore, the object of the present invention is to provide a method for making condenser microphones that is capable of overcoming the aforesaid drawback of the prior art.

According to this invention, a method for making condenser microphones comprises: forming a fixed electrode layer structure of a plurality of fixed electrode units; forming a sacrificial layer of a plurality of sacrificial units on one side of the fixed electrode layer structure such that the sacrificial units are aligned with the fixed electrode units, respectively; forming a diaphragm layer structure of a plurality of diaphragm units on the sacrificial layer such that the diaphragm units are aligned with the sacrificial units, respectively; forming a patterned mask layer on an opposite side of the fixed electrode layer structure opposite to the sacrificial layer; forming a plurality of etching channels, each of which extends through the patterned mask layer and the fixed electrode layer structure; removing a portion of the sacrificial layer of each of the sacrificial units by wet etching by passing an etchant into the etching channels so as to form a spacer between a respective one of the fixed electrode units and a respective one of the diaphragm units; and removing the patterned mask layer from the fixed electrode layer structure.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
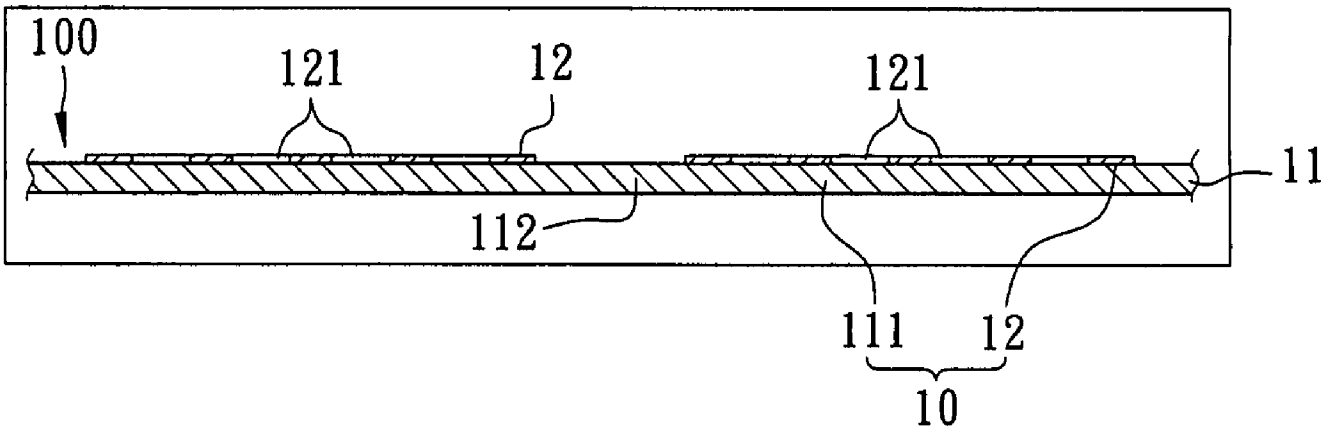
FIGS. 1 to 8 illustrate consecutive steps of the first preferred embodiment of a method for making condenser microphones according to this invention.
Figure 2:
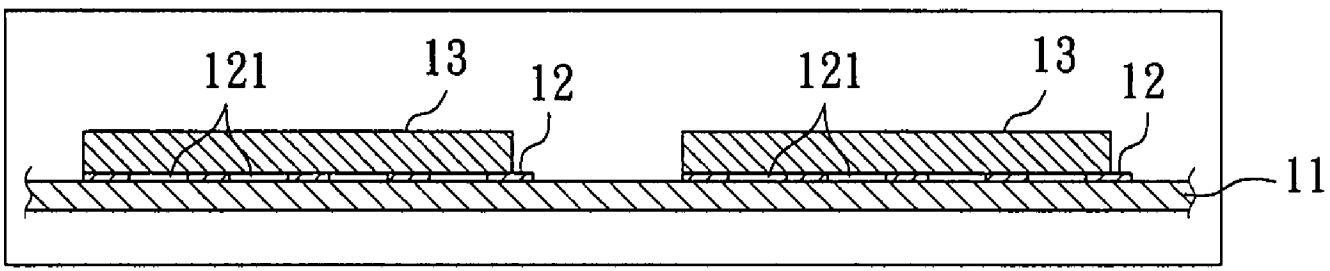
Figure 3:
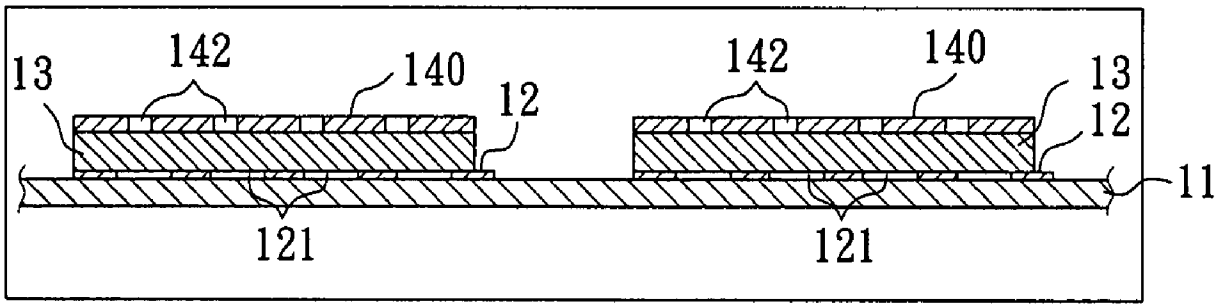

Before the present invention is described in greater detail with reference to the accompanying preferred embodiments, it should be noted herein that like elements are denoted by the same reference numerals throughout the disclosure.

FIGS. 1 to 8 illustrate consecutive steps of the first preferred embodiment of a method for making condenser microphones according to the present invention.

Figure 8:
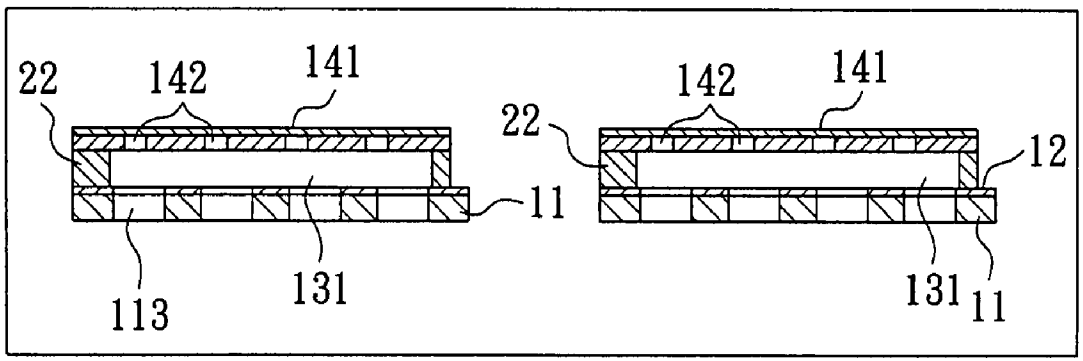
Figure 9:
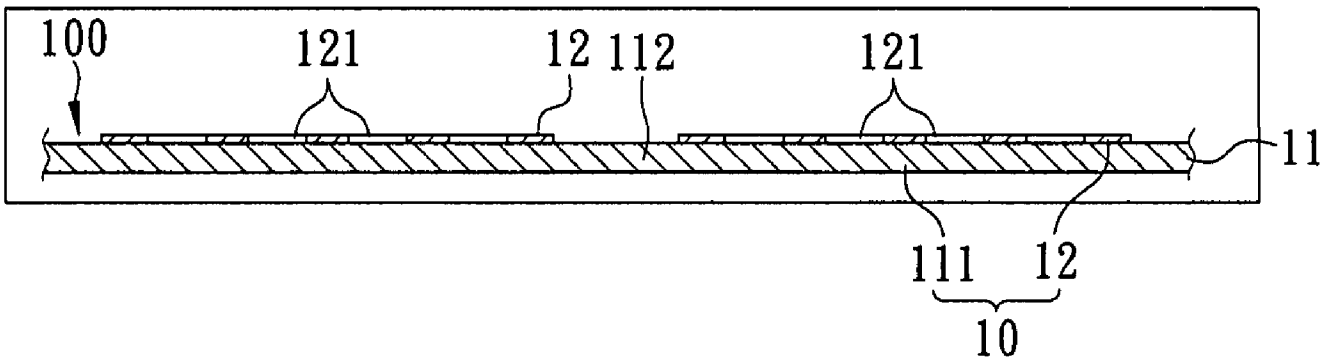
FIGS. 9 to 17 illustrate consecutive steps of the second preferred embodiment of a method for making condenser microphones according to this invention.
Figure 10:
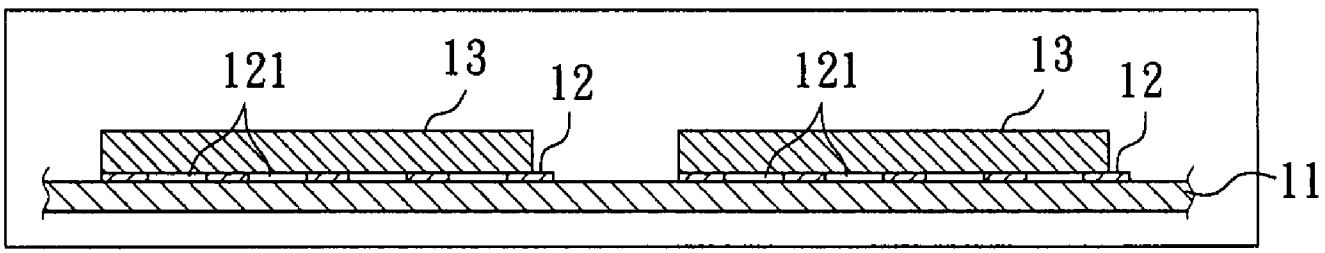
Figure 11:
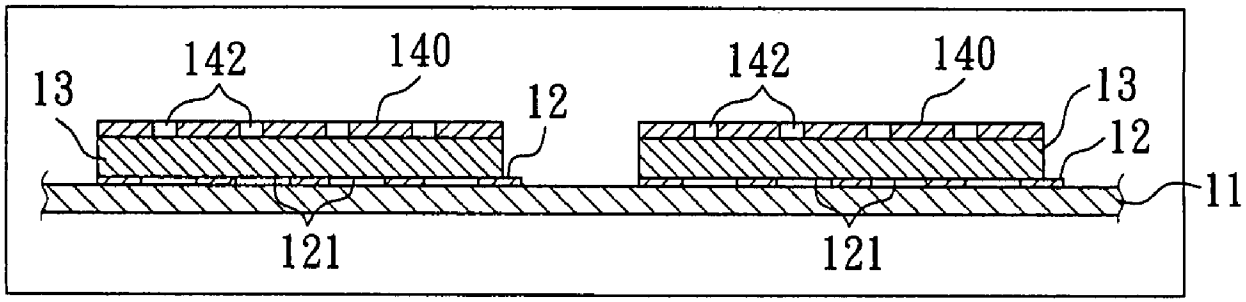
Figure 12:
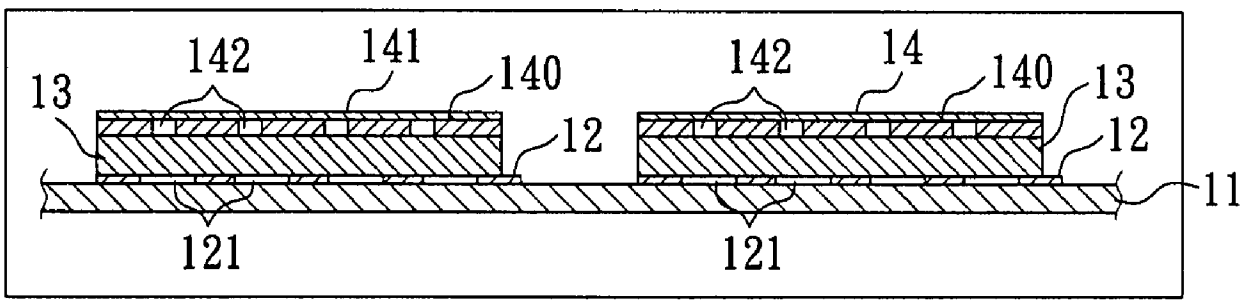
Figure 13:
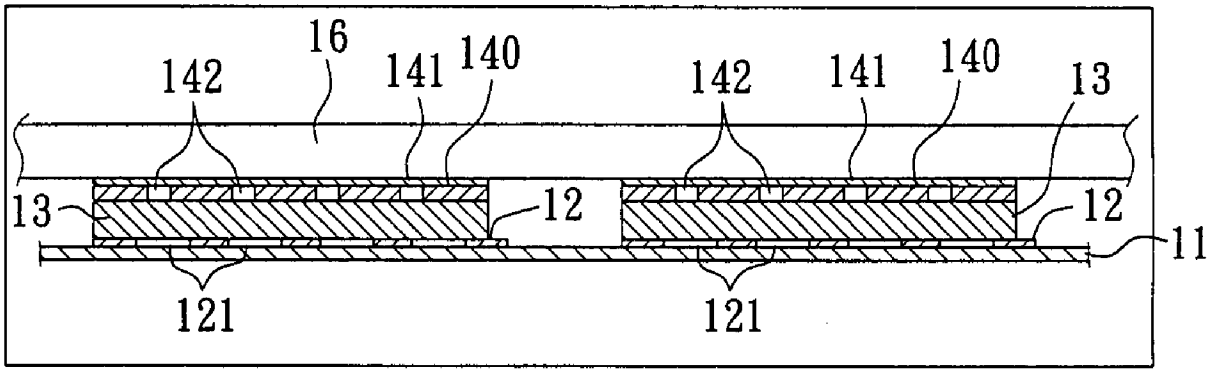
Figure 14:
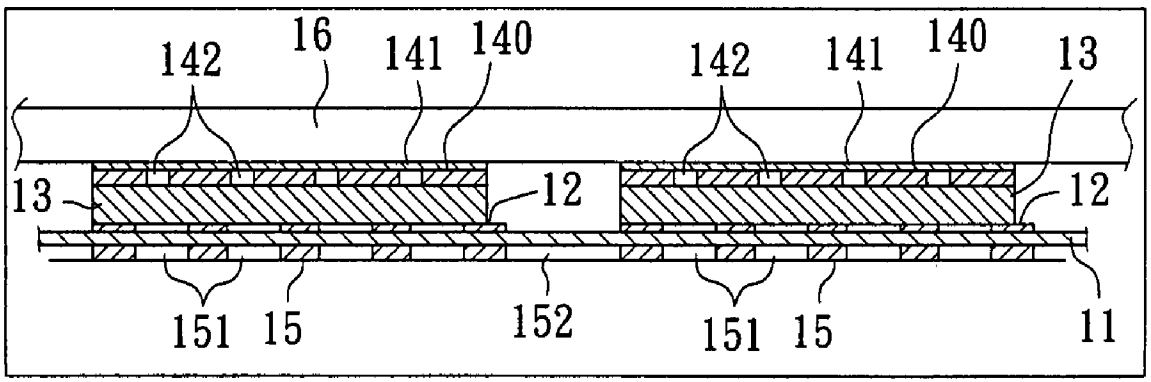
Figure 15:
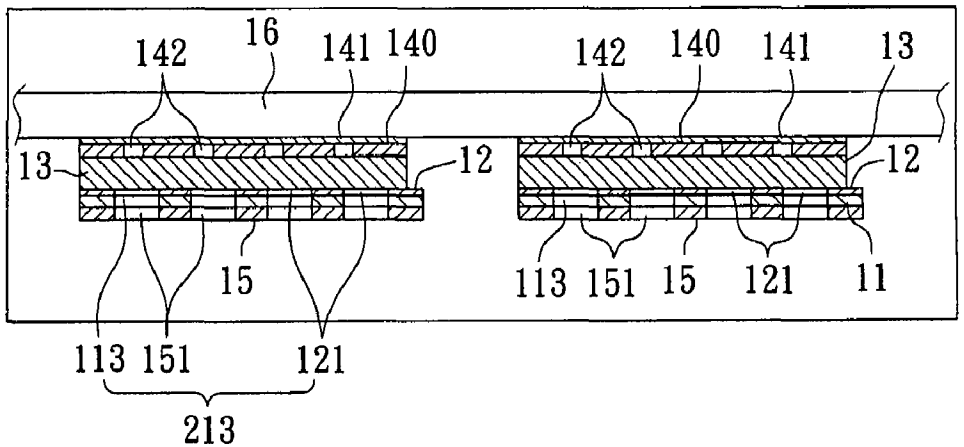
Figure 16:
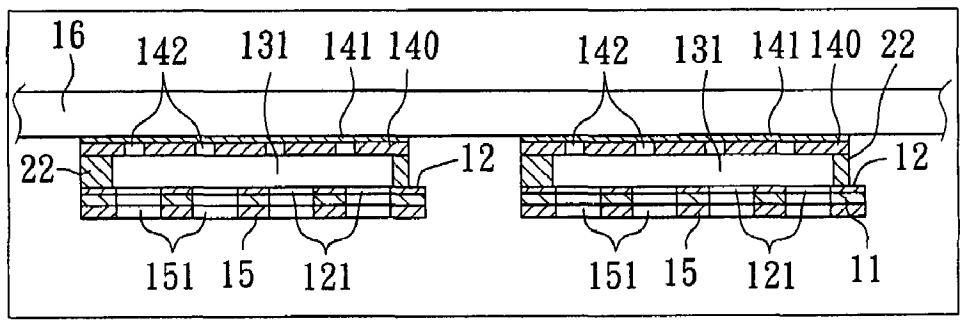
Figure 17:
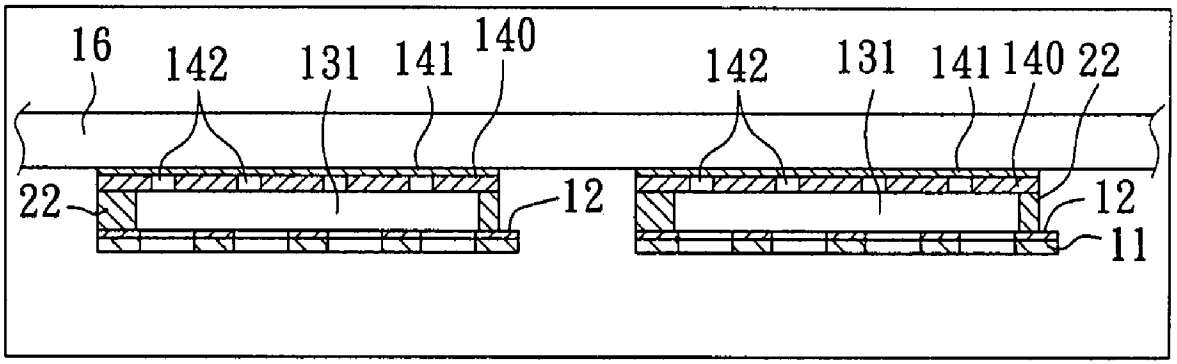
Figure 18:
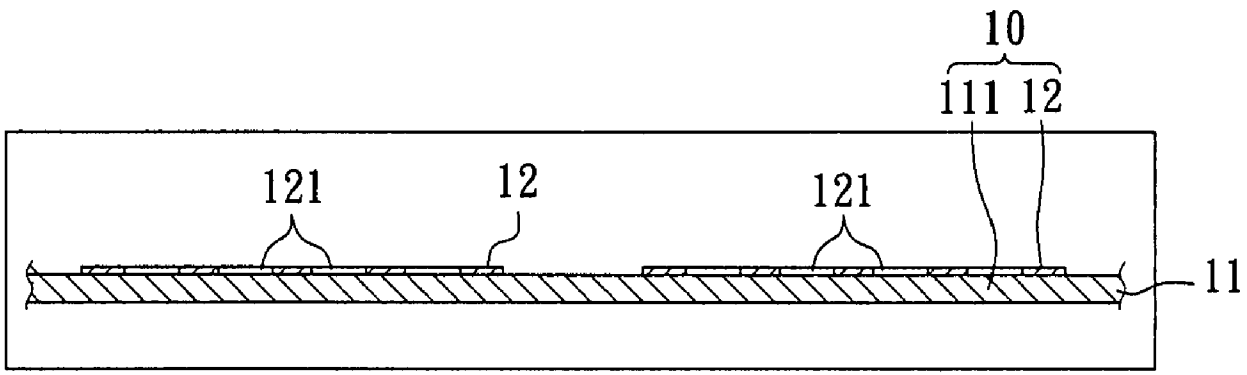
FIGS. 18 to 26 illustrate consecutive steps of the third preferred embodiment of a method for making condenser microphones according to this invention.
Figure 19:
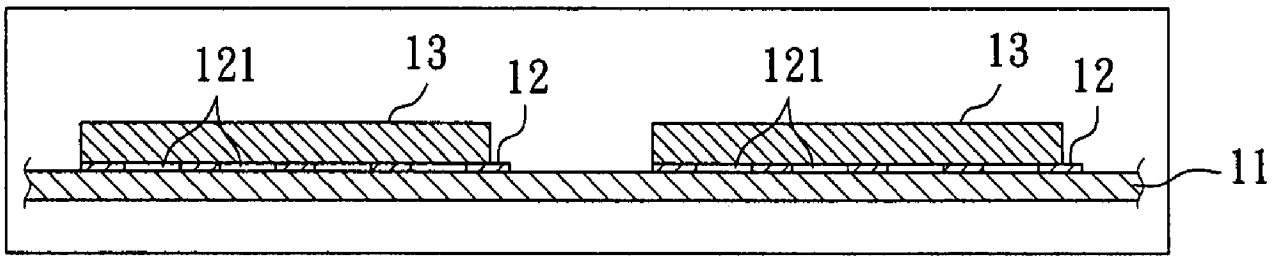
Figure 20:
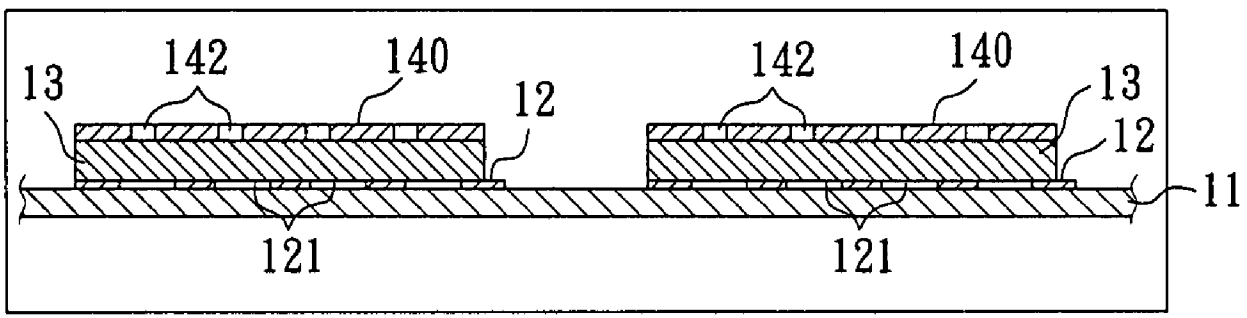
Figure 21:
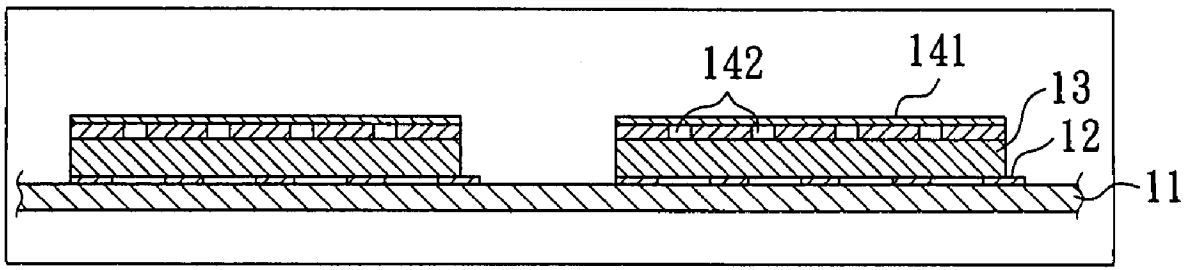
Figure 22:
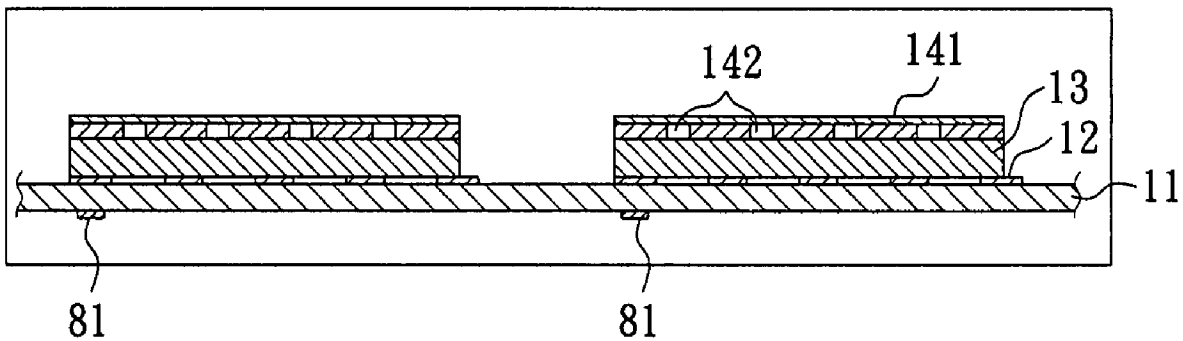
Figure 23:
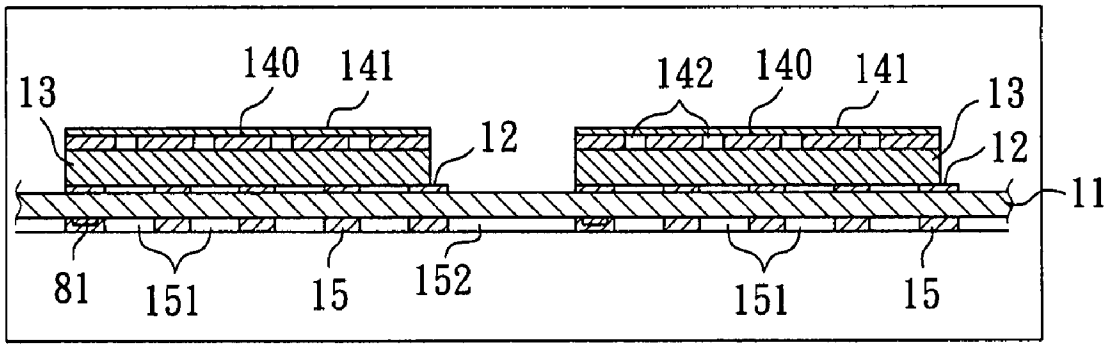
Figure 24:
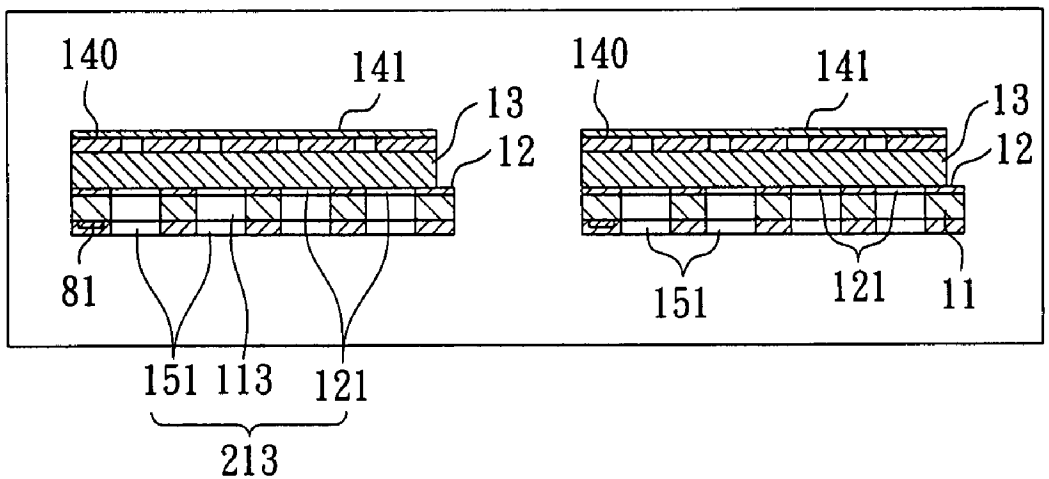
Figure 25:
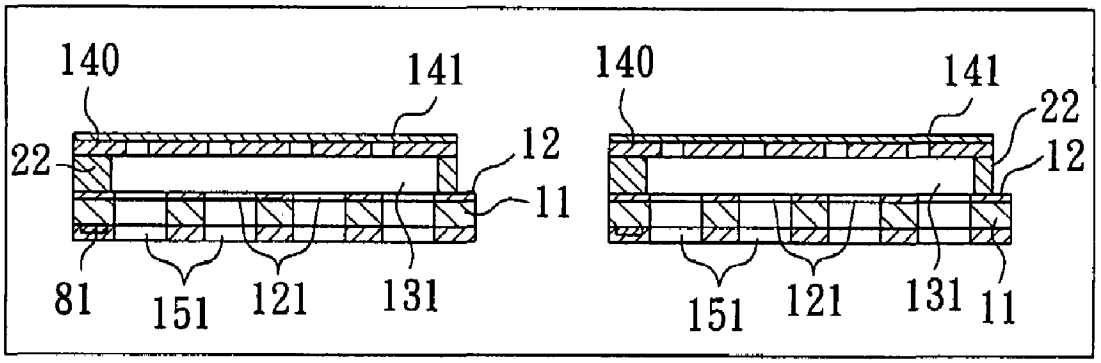
Figure 26:
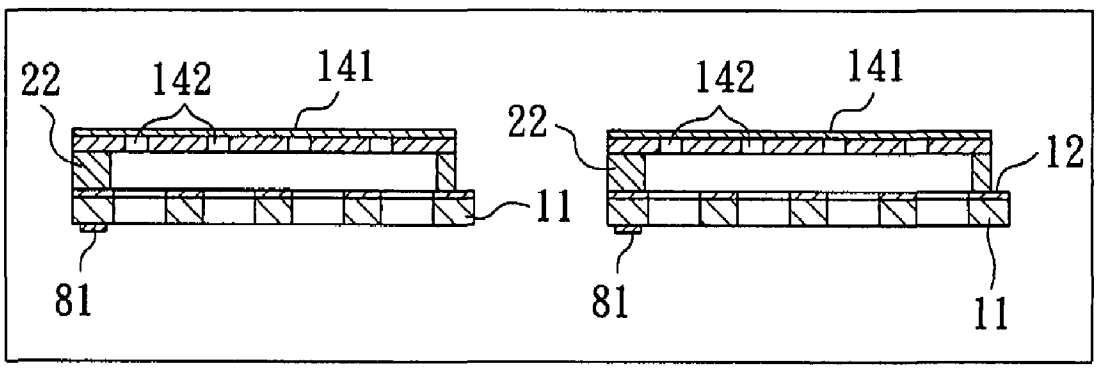

The method for making the condenser microphones includes: forming a fixed electrode layer structure 100 of a plurality of fixed electrode units 10 (see FIG. 1); forming a sacrificial layer of a plurality of sacrificial units 13 on one side of the fixed electrode layer structure 100 through plasma enhanced chemical vapor deposition (PECVD) such that the sacrificial units 13 are aligned with the fixed electrode units 10, respectively (see FIG. 2); forming a diaphragm layer structure of a plurality of diaphragm units 14 on the sacrificial layer such that the diaphragm units 14 are aligned with the sacrificial units 13, respectively (see FIGS. 3 and 4); forming a patterned mask layer 15 on an opposite side of the fixed electrode layer structure 100 opposite to the sacrificial layer (see FIG. 5); forming a plurality of etching channels 213, each of which extends through the patterned mask layer 15 and the fixed electrode layer structure 100 (see FIG. 6); removing a portion of the sacrificial layer of each of the sacrificial units 13 by wet etching by passing an etchant (e.g., buffer oxidation etchant) into the etching channels 213 so as to form a spacer 22 between a respective one of the fixed electrode units 10 and a respective one of the diaphragm units 14 (see FIG. 7); and removing the patterned mask layer 15 from the fixed electrode layer structure 100 (see FIG. 8).

Preferably, the step of forming the fixed electrode layer structure 100 is conducted by forming a first metal film of Cr/Au on a wafer substrate 11 (e.g., silicon substrate), followed by patterning the first metal film through photolithography techniques such that the patterned first metal film is formed into a plurality of fixed electrodes 12 on forming regions 111 of the wafer substrate 11 which are partitioned by etching regions 112 of the wafer substrate 11, and that each of the fixed electrodes 12 is formed with a plurality of etching through-holes 121. Each of the fixed electrodes 12 cooperates with a respective one of the forming regions 111 of the wafer substrate 11 to define a respective one of the fixed electrode units 10.

Preferably, the sacrificial layer is made from an inorganic material such as silica ($SiO_2$).

Figure 4:
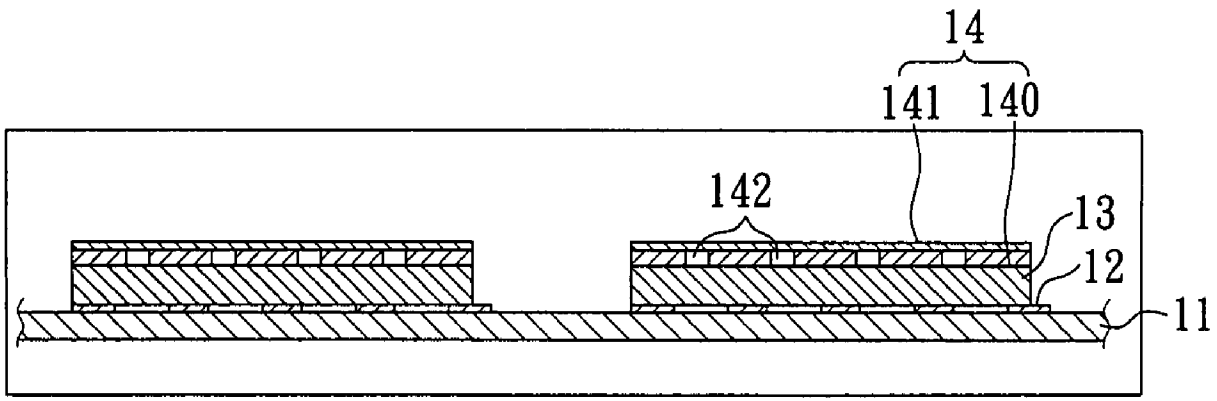
Figure 5:
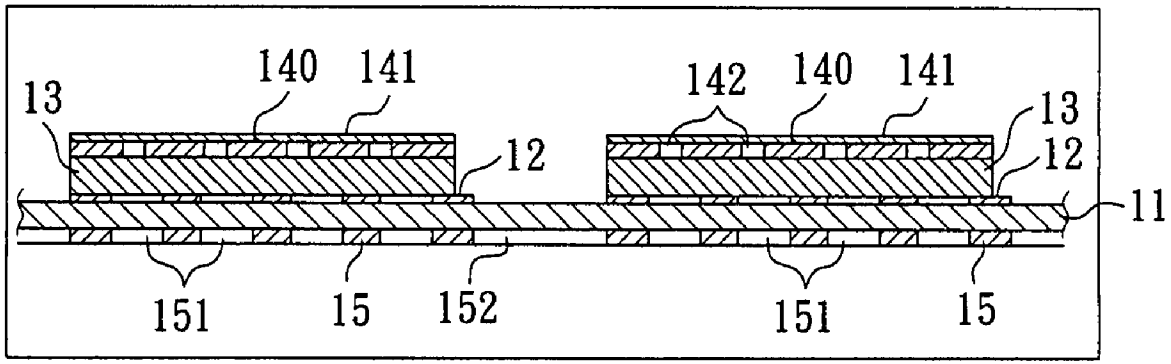
Figure 6:
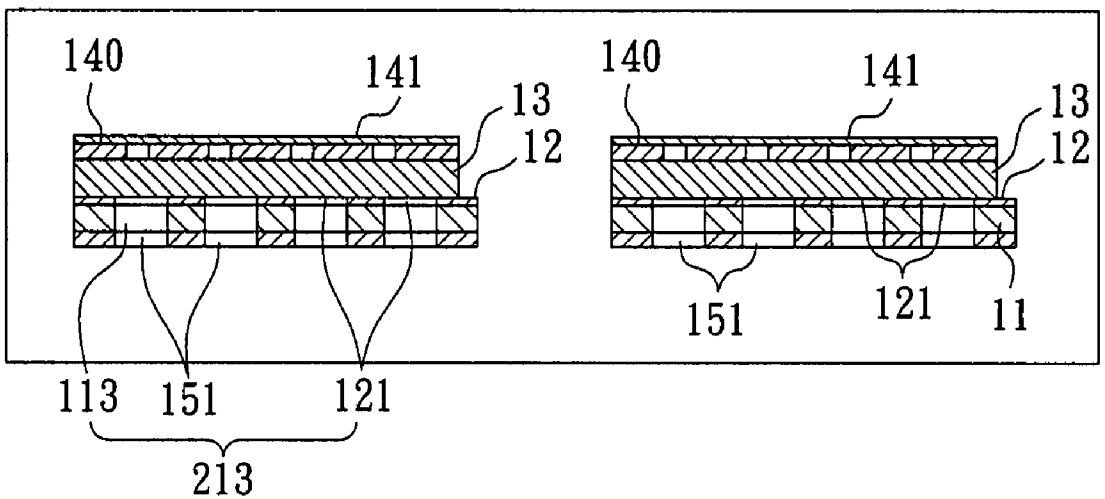
Figure 7:
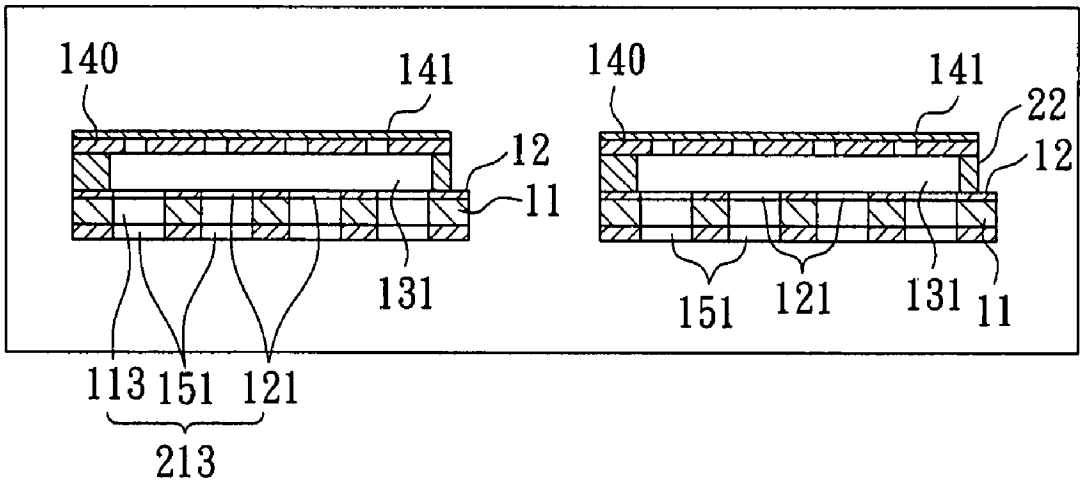

The step of forming the diaphragm layer structure is conducted by: depositing a dielectric film on the sacrificial layer by spin coating, followed by patterning the dielectric film through photolithography techniques such that the patterned dielectric film is formed into a plurality of dielectric units 140, each of which is formed on a respective one of the sacrificial units 13, and has a plurality of wave pressure-equalizing holes 142 (see FIG. 3); and forming a second metal film of Cr/Au on the patterned dielectric film and patterning the second metal film through photolithography techniques such that the patterned second metal film is formed into a plurality of diaphragm electrodes 141, each of which is formed on a respective one of the dielectric units 140 and each of which cooperates with the respective one of the dielectric units 140 to define a respective one of the diaphragm units 14 (see FIG. 4). In this invention, the dielectric film is made from an inorganic material selected from the group consisting of polysilicon, silicon nitride, silicon dioxide, and combinations thereof. Alternatively, the dielectric film can be made from a polymeric material selected from the group consisting of polyimide, parylene, benzocyclobutane (BCB), and poly methyl methacrylate (PMMA).

The patterned mask layer 15 is formed with a plurality of first etching through-holes 151 that are respectively aligned with the etching through-holes 121 in the fixed electrodes 12, and a plurality of second etching through-holes 152 that are respectively aligned with the etching regions 112 of the wafer substrate 11 using photolithography techniques.

After formation of the first etching through-holes 151 and the second etching through-holes 152 in the patterned mask layer 15, the exposed portions of the wafer substrate 11 that are exposed from the first etching through-holes 151 in the patterned mask layer 15 and the etching regions 112 that are exposed from the second etching through-holes 152 in the patterned mask layer 15 are dry etched using inductive coupling plasma etching techniques so as to form through-holes 113 in the wafer substrate 11 and so as to separate the forming regions 111 of the wafer substrate 11 from each other. Each of the through-holes 113 in the wafer substrate 11 cooperates with a respective one of the first etching through-holes 151 in the patterned mask layer 15 and a respective one of the etching through-holes 121 in the fixed electrodes 12 to define a respective one of the etching channels 213.

The space 131 formed by removing a portion of the sacrificial unit 13 serves as a variable gap chamber between each diaphragm unit 14 and a respective one of the fixed electrode units 10. Each of the through-holes 113 in the wafer substrate 11 serves as an entrance for sound waves to enter into the variable gap chamber (i.e., the space 131).

FIGS. 9 to 17 illustrate consecutive steps of the second preferred embodiment of the method for making condenser microphones according to the present invention. The second preferred embodiment differs from the first preferred embodiment in that this embodiment further includes a step of thinning the wafer substrate 11 using a grinding process before forming the patterned mask layer 15. Specifically, before forming the patterned mask layer 15, a glass plate 16 is attached to the diaphragm layer structure, followed by grinding the wafer substrate 11 to a thickness smaller than 50 μm such that the thickness of the wafer substrate 11 to be etched is considerably reduced, thereby resulting in a decrease in etching time and possible damage during the etching process.

FIGS. 18 to 26 illustrate consecutive steps of the third preferred embodiment of the method for making condenser microphones according to the present invention. The third preferred embodiment differs from the first preferred embodiment in that a highly doped p-type semiconductor material with ultra low resistance is used as the wafer substrate 11, and that a step of forming a plurality of ohm contact pads 81 through sputtering or evaporating process on the forming regions 111 of the wafer substrate 11 opposite to the patterned first metal film before forming the patterned mask layer 15 (see FIG. 22) is included in this embodiment. Each of the ohm contact pads 81 is electrically connected to a respective one of the fixed electrodes 12, and is exposed upon removal of the patterned mask layer 15 from the wafer substrate 11 after the variable gap chamber (i.e., the space 131) is formed.

Since separation of the condenser units is achieved during formation of the through-holes 113 in the wafer substrate 11 by etching, the aforesaid damage attributed to the dicing operation in the conventional methods can be eliminated.

While the present invention has been described in connection with what is considered the most practical and preferred embodiments, it is understood that this invention is not limited to the disclosed embodiments but is intended to cover various arrangements included within the spirit and scope of the broadest interpretation and equivalent arrangements.

What is claimed is:

1. A method for making condenser microphones, comprising:

forming a fixed electrode layer structure of a plurality of fixed electrode units;

forming a sacrificial layer of a plurality of sacrificial units on one side of the fixed electrode layer structure such that the sacrificial units are aligned with the fixed electrode units, respectively;

forming a diaphragm layer structure of a plurality of diaphragm units on the sacrificial layer such that the diaphragm units are aligned with the sacrificial units, respectively;

forming a patterned mask layer on an opposite side of the fixed electrode layer structure opposite to the sacrificial layer;

forming a plurality of etching channels, each of which extends through the patterned mask layer and the fixed electrode layer structure;

removing a portion of the sacrificial layer of each of the sacrificial units by wet etching by passing an etchant into the etching channels so as to form a spacer between a respective one of the fixed electrode units and a respective one of the diaphragm units; and removing the patterned mask layer from the fixed electrode layer structure.

2. The method of claim 1, wherein formation of the fixed electrode layer structure is conducted by forming and patterning a first metal film on a wafer substrate such that the patterned first metal film is formed into a plurality of fixed electrodes formed respectively on forming regions of the wafer substrate which are partitioned by etching regions of the wafer substrate, each of the fixed electrodes cooperating with a respective one of the forming regions of the wafer substrate to define a respective one of the fixed electrode units.

3. The method of claim 2, wherein each of the fixed electrodes is formed with a plurality of etching through-holes during formation of the patterned first metal film.

4. The method of claim 3, wherein the patterned mask layer is formed with a plurality of first etching through-holes that are respectively aligned with the etching through-holes in the fixed electrodes, and a plurality of second etching through-holes that are respectively aligned with the etching regions of the wafer substrate.

5. The method of claim 4, wherein formation of the etching channels is conducted by dry etching exposed portions of the wafer substrate that are exposed from the first etching through-holes in the patterned mask layer so as to form through-holes in the wafer substrate, each of the through-holes in the wafer substrate cooperating with a respective one of the first etching through-holes in the patterned mask layer and a respective one of the etching through-holes in the fixed electrodes to define a respective one of the etching channels.

6. The method of claim 5, further comprising removing simultaneously the etching regions of the wafer substrate from the forming regions of the wafer substrate by the dry etching during formation of the etching channels, thereby separating the forming regions of the wafer substrate from each other.

7. The method of claim 2, wherein formation of the diaphragm layer structure is conducted by forming and patterning a dielectric film on the sacrificial layer such that the patterned dielectric film is formed into a plurality of dielectric units, each of which is formed on a respective one of the sacrificial units, followed by forming and patterning a second metal film on the patterned dielectric film such that the patterned second metal film is formed into a plurality of diaphragm electrodes, each of which is formed on a respective one of the dielectric units and each of which cooperates with the respective one of the dielectric units to define a respective one of the diaphragm units.

8. The method of claim 7, wherein each of the dielectric units is formed with a plurality of wave pressure-equalizing holes.

9. The method of claim 7, wherein the dielectric film is made from an inorganic material selected from the group consisting of polysilicon, silicon nitride, silicon dioxide, and combinations thereof.

10. The method of claim 7, wherein the dielectric film is made from a polymeric material selected from the group consisting of polyimide, parylene, benzocyclobutane (BCB), and poly methyl methacrylate (PMMA).

11. The method of claim 2, further comprising a step of thinning the wafer substrate by grinding before forming the patterned mask layer.

12. The method of claim 11, wherein, before the thinning step, a glass plate is attached to the diaphragm layer structure.

13. The method of claim 2, further comprising a step of forming a plurality of ohm contact pads on the forming regions of the wafer substrate opposite to the patterned first metal film before forming the patterned mask layer, each of which being electrically connected to a respective one of the fixed electrodes, and being exposed upon removal of the patterned mask layer from the fixed electrode layer structure.

* * * * *